US005611881A

United States Patent [19]

Kimura et al.

[11] Patent Number: 5,611,881

[45] Date of Patent: Mar. 18, 1997

[54] METHOD OF THERMAL TRANSFER RECORDING ON MARKING FILM

[75] Inventors: Yasunori Kimura; Takeshi Yoshikawa; Akifumi Kuwabara; Tatsuya Nakao; Motohiko Kashioka; Hiromi Yokoyama; Hideaki Kumada; Toru Ohmura, all of Tokyo, Japan

[73] Assignee: Toyo Ink Manufacturing Co., Ltd., Tokyo, Japan

[21] Appl. No.: 105,068

[22] Filed: Aug. 12, 1993

[30] Foreign Application Priority Data

| | | | |
|---|---|---|---|
| Aug. 14, 1992 | [JP] | Japan | 4-239018 |
| Mar. 5, 1993 | [JP] | Japan | 5-44799 |
| Mar. 5, 1993 | [JP] | Japan | 5-44800 |
| Mar. 12, 1993 | [JP] | Japan | 5-52343 |

[51] Int. Cl.[6] ..... B44C 3/02

[52] U.S. Cl. ..... 156/241; 156/235; 156/240; 156/247

[58] Field of Search ..... 156/234, 240, 156/241, 235, 245, 247

[56] References Cited

U.S. PATENT DOCUMENTS

| | | | |
|---|---|---|---|
| 3,778,251 | 12/1973 | Trask | 156/245 X |
| 4,012,552 | 3/1977 | Watts | 156/234 X |
| 4,503,095 | 3/1985 | Seto et al. | 427/265 X |
| 4,597,815 | 7/1986 | Nakamura | 156/235 |
| 4,645,555 | 2/1987 | Kuboyama | 156/241 X |
| 4,678,687 | 7/1987 | Malhotra | 427/261 X |
| 4,707,707 | 11/1987 | Ohno | 346/76 PH X |
| 4,875,961 | 10/1989 | Oike et al. | 156/234 X |
| 4,914,079 | 4/1990 | Takei et al. | 503/227 X |
| 4,923,847 | 5/1990 | Ito et al. | 156/234 X |
| 5,071,502 | 12/1991 | Hashimoto et al. | 156/235 X |
| 5,120,383 | 7/1992 | Takei et al. | 156/240 |
| 5,133,820 | 7/1992 | Katayama et al. | 156/234 X |
| 5,147,489 | 9/1992 | Scrutton et al. | 156/235 X |
| 5,196,080 | 3/1993 | Mizobuchi et al. | 156/234 X |
| 5,209,462 | 5/1993 | Sakai | 156/241 X |
| 5,269,865 | 12/1993 | Kushida et al. | 156/235 X |
| 5,277,501 | 1/1994 | Tanaka et al. | 156/240 X |
| 5,296,444 | 3/1994 | Saiki et al. | 156/235 X |
| 5,320,885 | 7/1994 | Yamane et al. | 156/235 X |

FOREIGN PATENT DOCUMENTS

| | | | |
|---|---|---|---|
| 0228066 | 7/1987 | European Pat. Off. . | |
| 0367149 | 5/1990 | European Pat. Off. . | |
| 0022216 | 2/1979 | Japan | 156/240 |
| 1270186 | 11/1986 | Japan | 156/240 |
| 192598 | 8/1989 | Japan | 156/240 |
| 0308685 | 12/1989 | Japan | 156/234 |
| 2051680 | 1/1981 | United Kingdom | 156/240 |

*Primary Examiner*—David A. Simmons
*Assistant Examiner*—Paul M. Rivard
*Attorney, Agent, or Firm*—Wenderoth, Lind & Ponack

[57] ABSTRACT

A thermal transfer recording method forms a pattern on a marking film, which is a plastic film containing a heat adhesive resin or a plastic film on which a heat-sensitive image-receiving layer, composed mainly of a heat adhesive resin, is formed. A thermal transfer ribbon is prepared by forming a heat-melting ink layer on one surface of a substrate and is used to form the pattern on the marking film. The above method permits the facile formation of a fine or complicated multi-color character or pattern on a marking film in a quick thermal transfer operation at a low cost.

9 Claims, No Drawings

METHOD OF THERMAL TRANSFER RECORDING ON MARKING FILM

FIELD OF THE INVENTION

The present invention relates to a method of thermal transfer recording on a marking film having a thermal transfer recordability with a thermal transfer ribbon. More specifically, it relates to a thermal transfer recording method for obtaining a recording on a marking film, the recording having weatherability and scratch resistance in facile operation.

PRIOR ART

In general, a marking film formed from a polyester or urethane resin having toughness and refinement and a marking film formed of a polyvinyl chloride resin having a yield strength of 1 to 6 kg/mm$^2$ and a film thickness of approximately 30 to 150 μm and proper nerve are excellent in weatherability and dimensional stability. These marking films are therefore widely used as accent stripes and emblems for an automobile, tank stripes and emblems for a motorcycle, markings for a truck and a commercial vehicle, display materials such as indoor and outdoor advertisements, guide plates and decorative display materials such as window displays. Characters or patterns are generally prepared with patterning means such as a cutting machine with which characters or are made by patterns are directly cut or silk screen printing by which characters or patterns are printed.

When characters or patterns are cut out with a cutting machine, the minimum cut area constituting a character or pattern is limited by the accuracy of the cutting machine, and preparing a fine or complicated character or pattern has a limit. For fixing a large-size character or pattern consisting of a plurality of colors to a surface where it is to be fixed, applicator films whose number equals the number of the colors are used, and the use of the applicator films in such a number is uneconomical and inefficient. Further, the transfer of a character or pattern of colored pieces of films to the surface is complicated and takes a long time. The applicator film refers to a film to which colored pieces forming a character or pattern are to be temporarily attached for preventing the scattering of a cut character or pattern, facilitating the attaching of the said character or pattern to a surface to which it is to be fixed and attaching the character or pattern to the surface.

Screen printing used as a painting means permits the preparation of a complicated character or pattern, though it is inferior in immediate performance since it is carried but through printing plate preparation, proofing and printing. Further, the printing plate preparation and proofing require a high cost, so the production cost is relatively high when only a small quantity is required.

For coping with demands for the preparation of a multicolor display at a low cost, immediate performance and a fine character or pattern, painting a marking film by an ink jet recording method has been recently put to practical use.

In the ink jet recording method, an image is formed of dots. Therefore, a pattern having an intermediate tone is obtained, and there is an improvement in respect of a low cost and immediate performance. However, when the ink jet recording method is put to practical use, the resolution is low, and it is not suitable for the expression (display) in a small-size pattern and a fine character. Further, since the adhesion between an ink and a marking film is low, the scratch resistance is inferior, and the recording on the marking film is pool in outdoor weatherability. The ink nozzle is liable to clog, and the ink jet printing device requires a certain cost and amount of time for its maintenance and inspection.

Concerning materials forming marking films, JP-A-60-195146 discloses a semi-hard vinyl chloride resin molding composition comprising polyvinyl chloride, a liquid polyester-based plasticizer and an ethylene/vinyl ester resin. JP-A-63-24619 discloses a semi-hard vinyl chloride resin molding composition comprising a polyvinyl chloride resin, a liquid polyester-based plasticizer and either a low-molecular-weight acrylic resin or mothacrylic resin. These are all intended for overcoming conventional problems caused by bleed-out of a plasticizer such as decreases in flexibility, weatherability, retention of adhesion strength and adhesion to a printing ink. However, no patterning by thermal transfer is suggested.

The present inventors have made diligent studies by focusing on a method of patterning on a marking film by a thermal transfer method. That is because the thermal transfer method could presumably decrease the cost, permit an expression in multi-colors and obviate a plurality of steps for the preparation of a printing plate, printing, and the like, and because it would be advantageously suitable for an expression in a small-size pattern or fine characters. Therefore, attempts have been made to apply a thermal transfer method to the patterning on a marking film. In this case, the patterning on a marking film was possible. Since, however, a marking film has no receiving properties to a thermal transfer printing ink, the adhesion of a thermal transfer printing ink to a marking film is very low, and there is obtained no pattern having satisfactory scratch resistance, abrasion resistance and weatherability.

The present inventors have made diligent studies in view of the above problems, and consequently found that a fully satisfactory transfer character or pattern can be obtained by developing a marking film having properties such as thermal transfer receiving properties, weatherability, etc., and patterning on said marking film with a thermal transfer ribbon.

SUMMARY OF THE INVENTION

It is an object of the present invention to provide a thermal transfer recording method which permits the facile formation of a fine or complicated multi-color character or pattern on a marking film in a quick operation and at a low cost.

It is another object of the present invention to provide a thermal transfer recording method for the thermal transfer of a character or pattern to a marking film by means of a thermal transfer printer which permits facile maintenance and inspection.

According to the present invention there is provided a thermal transfer recording method comprising patterning on a marking film a which is a plastic film containing a heat adhesive resin or a plastic film on which a heat-sensitive image-receiving layer composed mainly of a heat adhesive resin is formed, with a thermal transfer ribbon prepared by forming a heat-melting ink layer on one surface of a substrate.

DETAILED DESCRIPTION OF THE INVENTION

The thermal transfer recording method of the present invention is carried out using a thermal transfer ribbon prepared by forming a heat-melting ink layer on one surface of a substrate and a marking film which is a plastic film containing a heat adhesive resin or which is a plastic film on which a heat-sensitive image-receiving layer composed mainly of a heat adhesive resin is formed.

In a specific embodiment using a marking film having a heat-sensitive image-receiving layer, the heat-melting ink layer and the image-receiving layer are stacked one on the other, and in this state, the heat-melting ink layer forming a character or a pattern is melt-transferred to the image-receiving layer by applying a heating means such as a thermal head to that side of the thermal transfer ribbon which is not in contact with the heat-melting ink layer, whereby the character or pattern is directly formed on the surface of the marking film. That is, when a plastic film contains a heat adhesive resin which can be easily melted at a heat volume applied during the thermal transfer recording, or when a plastic film has on its surface an image-receiving layer formed of the heat adhesive resin, the thermal transfer ink and the marking film which are in contact are easily thermally melted in an interface and allowed to adhere to each other at a heat volume and a pressure applied during the thermal transfer recording, whereby a character- or pattern-recorded film excellent in transfer properties and adhesion can be obtained.

The thermal transfer recording method of the present invention has the following advantages.

The present invention uses a thermal transfer printer which permits facile maintenance.

A desired image (i.e., a character or pattern) having a resolution depending upon the density of heat-generating elements of a thermal head can be immediately obtained at a low cost.

A multi-color image-recorded film can be obtained by carrying out transfer operations using thermal transfer ribbons which give different colors.

The thermal transfer recording method of the present invention can be used in combination with existing image forming means, such as silk screen printing.

The marking film on which a character or pattern is recorded by thermal transfer can be cut to any desired form.

That surface of the marking film which has a recorded character or pattern can be coated with a transparent plastic film.

The constituent members used in the thermal transfer recording method of the present invention will be explained hereinafter.

The marking film used in the present invention has a characteristic feature in that since it is a plastic film containing a heat adhesive resin or a plastic film having on the surface thereof a thermal transfer image-receiving layer composed mainly of a heat adhesive resin, it has excellent thermal transfer receiving propeties with respect to a heat-melting ink, which conventional marking films do not have.

The plastic film used in the present invention is a film formed from at least one of a polyvinyl chloride resin, a polyester resin, a polyurethane resin, polyethylene, polypropylene, polystyrene, nylon, polyimide and a polyvinyl resin. Preferred is a film formed from a polyvinyl chloride resin, a polyester resin or a polyurethane resin. The plastic film preferably has a thickness of 30 to 500 μm. Particularly preferred is a polyvinyl chloride resin film which has so high a flexibility that it can be uniformly attached to a curved or toughened surface.

The polyvinyl chloride resin has a polymerization degree of 300 to 2,000, preferably 600 to 1,500, and includes a polyvinyl chloride resin alone and a resin obtained by the copolymerization of vinyl chloride and other monomer such as an olefin monomer, a dierio monomer, a halogenated vinyl monomer, an acrylic ester monomer, a methacrylic ester monomer, a vinyl ester monomer or a styrene monomer. More specifically, the polyvinyl chloride resin includes an ethylene/vinyl chloride resin, a vinyl chloride/vinyl acetate resin, an ethylene/vinyl chloride/vinyl acetate resin and a urethane/vinyl chloride resin. In particular, a polyvinyl chloride resin having a softening point of 180° C. or lower serves to improve the adhesion to a heat-melting ink. The plastic film used in the present invention may be a film formed from one of the above polyvinyl chloride resins or at least two of them in combination.

The plastic film may contain known additives such as a plasticizer, a coloring material, a heat stabilizer, an ultraviolet absorbent, an antistatic agent, an antioxidant and a lubricant.

The plasticizer includes a low-molecular-weight ester plasticizer formed from a carboxylic acid and a monovalent or polyvalent alcohol, a liquid polyester plasticizer, an alkyd liquid plasticizer and an oxirane oxygen-containing epoxy plasticizer. The carboxylic acid includes phthalic acid, isophthalic acid, tetrahydrophthalic acid, adipic acid, sebacic acid, maleic acid, fumaric acid, trimellitic acid and oleic acid.

The coloring material includes colored organic pigments and inorganic pigments conventionally used in printing inks. Further, a colorless or white extender pigment may be incorporated for improving the fluidity and imparting the anchoring effect of a heat-melting ink. A colored coloring material is preferred for obtaining a marking film having an aesthetically fine appearance, and a white coloring material is preferred for showing a character or pattern in good contrast.

The heat stabilizer includes calcium stearate, barium stearate, lead stearate, basic lead sulfite, dibasic lead phosphite, dibutyltin dimaleate, dibutyl tin dilaurate, dibutyltin dimercaptide, dioctyltin dimaleate, dioctyltin dilaurate, dioctyltin dimercaptide, a tin.diol derivative and a complex of these.

The ultraviolet absorbent is selected from compounds which absorb light having a wavelength of 290 to 400 nm. The ultraviolet absorbent includes benzophenone compounds, benzotriazole compounds, salicylic acid phenyl ester compounds, cyanoacrylate compounds, cinnamic acid compounds and aminobutadiene compounds. An ultraviolet light shielding agent may be used. The ultraviolet light shielding agent includes titanium oxide fine powder, zinc white, talc, kaolin, calcium carbonate and iron oxide.

The antistatic agent includes polyoxyethylenealkylamine, polyoxyalkylamide, polyoxyethylene alkyl ether, glycerin fatty acid ester, sorbitan fatty acid ester, alkyl sulfonate, alkylbenzene sulfonate, alkyl sulfate, alkyl phosphate and quaternary ammonium sulfate. The antistatic agent particularly serves to prevent the adhering of dust which would cause the occurrence of a white spot in a recorded character or pattern.

The lubricant includes hydrocarbon lubricants such as liquid paraffin and polyethylene wax, fatty acid lubricants such as stearic acid and oxyfatty acid, fatty acid amide lubricants, natural or synthetic ester wax and alcohol lubricants. The lubricant is used in such an amount that it does not affect the thermal transfer. The lubricant improves the feeding of a marking film within a thermal transfer printer and the abrasion resistance of a marking film surface.

The heat adhesive resin includes a styrene/maleic anhydride copolymer, a styrene/acrylate copolymer, a styrene/methacrylate copolymer, polyvinyl acetate, a vinyl chloride/vinyl acetate copolymer, polyethylene, polypropylene, polyacetal, an ethylene/vinyl acetate copolymer, an ethylene/acrylate copolymer, an α-olefin/maleic anhydride copolymer, an esterification product of an α-olefin/maleic anhydride copolymer, polystyrene, polycaprolactone, polyacrylate, polymethacrylate, polyamide, an epoxy resin, a xylene resin, a ketone resin, a petroleum resin, sucrose ester, rosin or rosin derivatives, a coumarone-indene resin, a terpene resin, a polyurethane resin, synthetic rubbers such as styrene-butadiene rubber, polyvinyl butyral, nitrile rubber, acryl rubber and ethylene/propylene rubber, and a polyester resin.

Of the above heat adhesive resins, preferred are those which are hard solids or have no adhesion properties at room temperature. These resins generally have a glass transition temperature (to be referred to as Tg hereinafter) of −30° to 80° C. or a softening or melting point of 40° to 180° C. Particularly preferred are those resins having Tg of −10° to 30° C. and a softening or melting point of 50° to 150° C. A resin having Tg lower than the above lower limit and a softening or melting point lower than the above lower limit shows adhesion properties or fluidity at room temperature. As a result, a marking film undergoes a change with time, and it is liable to cause troubles such as blocking. Further, when a marking film is used outdoors, soot and smoke in the atmosphere are adsorbed on the marking film surface to render it unclean. A resin having Tg higher than the above upper limit and a softening or melting point higher than the above upper limit is poor in heat sensitivity, and very poor in image transfer properties.

As the heat adhesive resin, particularly preferred see a highly crystalline or partially crystalline resin such as polycaprolactone of the formula of $—(CH_2CH_2CH_2CH_2CH_2COO)_n—$ (melting point, about 60° C.), a crystalline polyester resin, an epoxy resin and sucrose ester.

In particular, sucrose octabenzoate (melting point 78° C.) and sucrose octaacetate (melting point 72° C.) satisfy the above requirements of hard solids and no adhesion properties at room temperature, and they have sharp melting points and low melting viscosity similar to that of wax and thus satisfy the heat sensitivity, which is one of the important properties for thermal transfer. Further, sucrose octabenzoate is remarkably suitable since it improves the weatherability. Sucrose octabenzoate decreases the film strength to some extent when used alone, and it is therefore preferred to use sucrose octabenzoate in combination with a resin which can give a film having high strength. The amount of sucrose octabenzoate based on the total amount of heat adhesive resins is preferably 10 to 90% by weight, more preferably 30 to 90% by weight.

For improving the marking film in anti-blocking properties and soot and smoke resistance, it is preferred to use a fluorine-containing compound or a silicon-modified resin in combination with the above heat adhesive resin. The fluorine-containing compound includes a graft polymer in which acryl side chains bond to a main chain of a fluorine resin, fluorine-containing copolymer resins such as a copolymer obtained from a polyfluoro group-containing vinyl monomer and other vinyl monomer, a fluorine-containing surfactant and a fluorine-containing wax. The silicon-modified resin includes a resin in which polyorganosiloxane is introduced into a main chain or side chains. Above all, preferred are a silicon-modified polyurethane resin having a polyorganosiloxane chain in the main chain and silicon-modified acrylic resin having a polyorganosiloxane chain in the side chains. The heat adhesive resin may be used in combination with other resin.

The marking film which is a plastic film containing the heat adhesive resin is produced by forming a resin composition containing 100 parts by weight of any resin described regarding the plastic film and 1 to 40 parts by weight of the heat adhesive resin into a film. The molding method includes an extrusion method, a calender method, a solution casting method, a sol casting method and a semi-sol casting method. Of these methods, particularly preferred are a sol casting method or a semi-sol casting method which do not involve lot roll processing in the formation of a film, since the resin composition contains the heat adhesive resin.

When the marking film is formed by hot processing such as a calender method, the content of the heat adhesive resin in the plastic film is preferably 5 to 10 parts by weight for preventing the adhesion of the film to hot rolls or properly securing the film flexibility required when the marking film is used. When the marking film is produced by a casting method, the heat adhesive resin is required to be soluble in a solvent used, or a heat adhesive resin which is not at all soluble in a solvent cannot be used. In this case, a casting solution may contain a partially swollen undissolved resin. For example, a marking film which is a vinyl chloride copolymer film containing a heat adhesive resin is produced by a casting method as follows. The vinyl chloride copolymer resin, the heat adhesive resin, a plasticizer, a solvent and other optional component(s) are mixed and stirred to prepare a high-viscosity coating solution in a paste-like and sol-like state, and cast over a support sheet having film releasability, such as a silicon-containing process paper sheet having film releasability or a stainless steel plate treated to have film releasability. Then, the high-viscosity coating solution is melted by heating it at 160 to 220° C. for approximately 1 to 10 minutes, whereby the intended marking film having a thickness of 30 to 150 μm can be obtained. The solvent is selected from organic solvents for a sol such as butanol, butyl acetate, acetic acid, ethylene glycol monomethyl ether, diisobutyl ketone, xylene, cyclohexanone, aromatic petroleum naphtha, solvent naphtha and trichlene. These solvents may be used alone or in combination.

The marking film which is a plastic film having on the surface a heat-sensitive image-receiving layer composed mainly of the heat adhesive resin can be produced by a solvent coating method in which a composition for forming an image-receiving layer is dissolved or dispersed in a solvent or water to prepare a coating solution and the coating solution is applied and then dried, or by a hot-melt coating method in which a composition for forming an image-receiving layer is melted under heat to form the layer. The thickness of the heat-sensitive image-receiving layer is preferably approximately 0. 1 to 10 μm, more preferably approximately 0.2 to 2 μm.

The heat-sensitive image-receiving layer is composed mainly of the above heat adhesive resin, while it may contain the above additives such as a plasticizer, coloring material, an ultraviolet absorbent and an antistatic agent.

For further improving the marking film in outdoor weatherability and soot and smoke resistance, the marking film may be produced by forming on a plastic film a highly-heat sensitive first image-receiving layer composed mainly of a heat adhesive resin having TM of −30° to 30° C. or a softening or melting point of 40° to 80° C. and further forming thereon a second image-receiving layer excellent in weatherability and soot and smoke resistance which is mainly composed of a heat adhesive resin having Tg of 30° to 80° C. or a softening or melting point of 80° to 180° C. or which is composed of a resin mixture of the above heat adhesive resin with the above fluorine-containing compound or silicon-modified resin. In this case, the thickness of the second image-receiving layer is preferably as small as possible for preventing a decrease in transfer image receiving properties. That is, the above thickness is preferably 0.5 μm or less, more preferably 0.1 μm or less.

A character or pattern is transferred to one surface of the marking film from the thermal transfer ribbon. The other surface of the marking film may be coated with an adhesive such as an acrylic adhesive, a urethane adhesive, a rubber adhesive or a silicon adhesive in a coating thickness of 10 to 200 μm and then with a separable sheet. The adhesive is generally selected from those having an adhesion strength of 1,000 to 2,000 gr/25 mm width (JIS-Z0237, adhesive tape adhesive sheet test method) depending upon the material and surface state of a surface to which the marking film is to be attached. Further, the adhesive may be selected from those adhesives having an adhesion strength of 50 to 1,000 gr/25 mm width, preferably 500 to 900 gr/25 mm width. In this case, the marking film can be peeled off without any residual adhesive on the surface to which the marking film has been attached and without any peel strength exceeding the breaking strength of the marking film.

The thermal transfer ribbon used in the present invention includes known thermal transfer ribbons such as a single-layered ribbon prepared by forming a single heat-melting ink layer on a substrate and a multi-layered ribbon prepared by forming a plurality of layers having different functions on a substrate. Of these ribbons, a multi-layered ribbon is preferred. Above all, preferred is a multi-layered thermal transfer ribbon prepared by consecutively laminating a releasing layer and a coloring ink layer (both layers forming a heat-melting ink layer) on a substrate. For improving the properties such as weatherability, adhesion and scratch resistance, the coloring ink layer does not contain a general wax which affects the above properties, but preferably consists essentially of a coloring material and a resin. Further, the multi-layered thermal transfer ribbon may have an adhesive layer on the coloring ink layer fox improving the adhesion.

The substrate used in the thermal transfer ribbon includes a polyester film excellent in heat resistance and mechanical strength (e.g., polyethylene terepthalate and polybutylene terephthalate), a polyolefin film (e.g., polypropylene), a polyamide film (e.g., nylon), a cellulose film (e.g., triacetate) and a polycarbonate film. A polyester film is particularly preferred, since it is excellent in heat resistance, mechanical strength, tensile strength and tensile stability. The smaller the thickness of the substrate is, the higher the thermal conductivity is. In view of strength and easiness in forming the heat-melting ink layer, the thickness of the substrate is most preferably approximately 3 to 50 μm. The heat-melting ink layer is formed on one surface of the substrate. The other surface of the substrate may be provided with a back coating formed of a heat-resistant resin.

The heat-melting ink layer is formed from coloring materials such as an organic pigment and an inorganic pigment and a vehicle. Tile vehicle includes natural waxes such as plant-derived wax, animal-derived wax, mineral-derived wax and petroleum-derived wax, synthetic wax, higher fatty acid, higher fatty acid derivative and a resin having a softening point of 200° C. or lower.

In the present invention, the marking film is imparted with heat-sensitive image receiving properties, and therefore, a recorded marking film excellent in adhesion and abrasion resistance can be obtained even when the thermal transfer ribbon has a heat-melting ink layer composed mainly of a wax. Further, for improving the surface strength and outdoor weatherability of a recorded portion of the marking film, it is preferred to use a thermal transfer ribbon obtained by forming a releasing layer containing a wax on a substrate and then forming a coloring ink layer consisting essentially of a coloring material and a resin, but containing no wax, on the releasing layer. A wax contained in the coloring ink layer serves to improve the heat sensitivity during the transfer. However, the marking film having a character or pattern recorded thereon shows a decrease in durability, particularly scratch resistance and adhesion, in a high-temperature environment (around 40° C.). When the coloring ink layer contains about 5% by weight of a wax, the marking film having a recording shows a decrease to some extent in the above properties as compared with the case where no wax is contained in the coloring ink layer. When the coloring ink layer contains about 20% by weight of a wax, the above properties clearly deteriorate, and in particular, the scratch resistance greatly deteriorates. When the coloring ink layer contains 50% by weight or more of a wax, the above properties deteriorate by 50 percent or more. The heat sensitivity decreases when the coloring ink layer contains no wax. However, this decrease in heat sensitivity can be fully compensated by the thermal transfer image receiving properties of the marking film.

The coloring material/resin weight ratio of the coloring ink layer specially has an influence on the undercolor concealing performance, color density and resolution. When the coloring material is an organic pigment, the above ratio is preferably 0.5 to 4. When the coloring material is an inorganic pigment, the above ratio is preferably 0.5 to 6 since inorganic pigments have greater specific gravity. When the above weight ratio is smaller than the above range, the concealing performance, i.e., the color density decreases, and the coloring ink layer shows too high a film strength to obtain sharpness during the transfer. That is, the resolution decreases. When the above weight ratio is greater than the above range, the adhesion and abrasion resistance decrease. The coloring ink layer may contain known additives in an amount of 5% by weight or less based on the total amount of solid contents as required. The thickness of the coloring ink layer is preferably 0.3 to 5 μm, more preferably 0.5 to 3 μm.

The releasing layer is composed from a wax and a resin, while the separable layer may further contain known additives such as a coloring material, a pigment diapersant, an antistatic agent, a plasticizer and an ultraviolet absorbent as required. The thickness of the releasing layer influences the transferring performance, and it is preferably 0.1 to 3 μm, more preferably 0.3 to 2 μm.

The resin used in the heat-melting ink layer is selected from those having a softening point of 200° C. or lower, such as polyvinyl acetate, a vinyl chloride/vinyl acetate copolymer, polyethylene, polypropylene, polyacetal, an ethylene/vinyl acetate copolymer, an ethylene/acrylate copolymer, an α-olefin/maleic anhydride copolymer, an esterification product of an α-olefin/maleic anhydride copolymer, polystyrene, polyacrylate, polymethacrylate, an α-olefin/maleic anhydride/vinyl group-containing monomer copolymer, a styrene/maleic anhydride copolymer, a styrene/acrylate copolymer, polyamide, an epoxy resin, a xylene resin, a ketone resin, a petroleum resin, rosin or resin derivatives, a coumarone-indene resin, a terpene resin, a polyurethane resin, synthetic rubbers such as styrene-butadiene rubber, polyvinyl butyral, nitrile rubber, acryl rubber and ethylene/propylene rubber, a polyester resin, nitrocellulose, cellulose derivatives, a sucrose esters. Above all, preferred are a resin obtained by copolymerizing an α-olefin having at least 6 carbon atoms, relative anhydride and (meth)acrylate, sucrose octabenzoate (included in sucrose esters) and sucrose octaacetate (included in sucrose esters) in view of their heat sensitivity.

When an adhesive layer is laminated on a coloring ink layer, preferred are a resin, as a main component of the adhesive layer, obtained by copolymerizing at least one compound selected from the group of α-olefin having at lease 6 carbon atom, maleic anhydride and (meth)acrylate for improving the adhesion and transfer properties.

The heat-melting ink layer can be formed by any known method, such as a hot melt coating method or, preferably, a gravure coating method.

According to the present invention, highly vivid and accurate images including characters and patterns can be formed on the marking film containing the heat adhesive resin having heat-melting ink receiving properties, or on the marking film having the heat-sensitive image-receiving layer, in a facile operation. Therefore, the pattern processing can be easily carried out with immediate productivity at a low cost without carrying out complicated steps. Further, a marking film on which images including characters and patterns have been recorded can be fully practically used, since it retains flexibility, surface smoothness, dimensional stability and weatherability, which are all required fox practical use of marking films and since the heat-melting ink shows excellent adhesion.

The present invention will be explained more in detail hereinafter. In the Examples, "part" stands for "part by weight".

PREPARATION EXAMPLE 1

Marking film A

The raw materials for a marking film A and their amounts were as shown below.

| Film | |
|---|---|
| Titanium oxide pigment (TIPAQUE CR80, supplied by Ishihara Sangyo Kaisha, Ltd.) | 30 parts |
| Liquid polyester plasticizer (ADEKACIZER PN260, supplied by Asahi Denka Kogyo K.K.) | 20 parts |
| Liquid phthalic acid ester plasticizer (DOP, supplied by Chisso Corp.) | 15 parts |
| Heat-bonding resin (JONCRYL 611, styrene-acrylic resin, softening point 105° C., supplied by Johnson Polymer Corp.) | 20 parts |
| Heat stabilizer (BZ100C, supplied by Katsuta Kako K.K.) | 3 parts |
| Ultraviolet absorbent (TINUVIN 326, supplied by Ciba Geigy) | 2 parts |
| Solvent (xylene/diisobutyl ketone = 1/1) | 284 parts |
| Vinyl chloride resin (ZEON 24, polymerization degree 1,300, supplied by Nippon Zeon Co., Ltd.) | 100 parts |
| Lubricant (stearyl alcohol) | 1 part |
| **Adhesive** | |
| Acrylic pressure-sensitive adhesive (ORIBAIN BPS4089B, supplied by Toyo Ink Mfg. Co., Ltd.) | 100 parts |
| Isocyanate hardener agent (ORIBAIN BHS4089B, supplied by Toyo Ink Mfg. Co., Ltd.) | 0.87 part |

The titanium oxide pigment and the plasticizers were preliminary mixed, and the mixture was fully kneaded with a three-roll mill to prepare a coloring paste. Then, heat adhesive resin, the heat stabilizer, the ultraviolet absorbent and the lubricant were dissolved in the solvent to prepare a resin solution. The vinyl chloride resin powder and the above-prepared paste were added to the resin solution such that the total solid content was about 60%, and the mixture was fully stirred with a mixer with cooling to give a sol paste. The sol paste was fully defoamed and applied to a separable paper sheet with an applicator such that the dry coating thickness was about 100 μm, and the applied paste was fully dried with hot air to give a resin film.

Separately, there was prepared a releasable paper sheet which had been formed by coating both surfaces of a 100 μm thick paper sheet with polyethylene and treating one surface of the resultant polyethylene-laminated film with a releasing agent. An adhesive obtained by fully mixing and stirring the above raw materials for an adhesive was applied to the releasable paper sheet such that the dry weight was 25 gr/m$^2$, and dried at 100° C. for 2 minutes This adhesive had an initial adhesion strength of 1,200 gr/25 mm width (JIS-Z0237, adhesive tape adhesive sheet test method), and after it was allowed to stand at 65° C. at 80% RH for 168 hours, it showed an adhesion strength of 1,500 gr/25 mm width. This adhesive-applied releasable paper sheet and the above-prepared resin film were laminated to give the intended adhesive-applied marking film A. Then, the separable paper sheet was taken off.

PREPARATION EXAMPLE 2

Marking film B

An adhesive-applied marking film B was obtained in the same manner as in Preparation Example 1 except that the heat adhesive resin "JONCRYL 611" was replaced with sucrose octabenzoate (MONOPET SB, melting point 78° C., supplied by Daiichi Kogyo Seiyaku Co., Ltd.).

PREPARATION EXAMPLE 3

Marking film C

The raw materials for a marking film C and their amounts were as shown below.

| Film | |
|---|---|
| Titanium oxide pigment (TIPAQUE CR80, supplied by Ishihara Sangyo Kaisha, Ltd.) | 30 parts |
| Vinyl chloride resin (ZEON 24, polymerization degree 1,300, supplied by Nippon Zeon Co., Ltd.) | 100 parts |
| Heat-bonding resin (VYLON 103, softening point 158° C., saturated polyester resin supplied by Toyobo Co., Ltd.) | 20 parts |
| Liquid polyester plasticizer (ADEKACIZER PN260, supplied by Asahi Denka Kogyo K.K.) | 20 parts |
| Liquid phthalic acid ester plasticizer (DOP, supplied by Chisso Corp.) | 15 parts |
| Heat stabilizer (BZ100C, supplied by Katsuta Kako K.K.) | 3 parts |
| Ultraviolet absorbent (TINUVIN 326, supplied by Ciba Geigy) | 2 parts |
| Lubricant (stearyl alcohol) | 1 part |
| **Adhesive** | |
| Acrylic pressure-sensitive adhesive (ORIBAIN BPS4294, supplied by Toyo Ink Mfg. Co., Ltd.) | 100 parts |
| Isocyanate hardener agent (ORIBAIN BHS4089B, supplied by Toyo Ink Mfg. Co., Ltd.) | 2 parts |

The titanium oxide pigment and the plasticizers were preliminarily kneaded with a two-roll mill. Then, the heat adhesive resin, the heat stabilizer, the ultraviolet absorbent, the vinyl chloride resin and the lubricant were added to the above-kneaded mixture, and the mixture was fully kneaded while it was melted under heat. The resultant kneaded mixture was rolled under heat with a calender roll to give a resin film having a thickness of about 100 μm.

An adhesive obtained by fully mixing and stirring the above raw materials for an adhesive was applied to the same releasable paper sheet as that used in Preparation Example 1 such that the dry weight was 25 gr/m$^2$, and fully dried with hot air. This adhesive had releasability and had an initial adhesion strength of 500 gr/25 mm width (JIS-Z0237, adhesive tape adhesive sheet test method), and after it was allowed to stand at 65° C. at 80% RH for 168 hours, it slowed an adhesion strength of 750 gr/25 mm width. This adhesive-applied releasable paper sheet and the above-prepared resin film were laminated to give the intended adhesive-applied marking film C.

PREPARATION EXAMPLE 4

Marking film D

The raw materials for a marking film D and their amounts were as shown below.

| Film | |
|---|---|
| Titanium oxide pigment (TIPAQUE CR80, supplied by Ishihara Sangyo Kaisha, Ltd.) | 30 parts |
| Polyurethane resin (dicyclohexylmethane diisocyanate/polyhexamethylene carbonate diol (Mw 1,000)/propylene glycol/isophoronediamine = 4/1/1/1 (molar ratio)) | 100 parts |
| Heat-bonding resin (VYLON 103, softening point 158° C., saturated polyester resin supplied by Toyobo Co., Ltd.) | 20 parts |
| Ultraviolet absorbent (TINUVIN 326, supplied by Ciba Geigy) | 2 parts |
| Lubricant (stearyl alcohol) | 1 part |
| Solvent (cyclohexanone/diisobutyl ketone = 2/1) | 400 parts |

The above raw materials were fully dispersed and mixed in a ball mill to obtain a casting solution. The casting solution was applied to a separable paper sheet with an applicator such that the dry coating thickness was about 100 μm, and fully dried with hot air to give a resin film.

PREPARATION EXAMPLE 5

Marking film E

The raw materials for a marking film E and their amounts were as shown below.

| Image receiving layer | |
|---|---|
| Heat-bonding resin (DESMOCOLL 530, softening point 85° C., polyurethane resin, supplied by Sumitomo Bayer Urethane Co., Ltd.) | 10 parts |
| Ultraviolet absorbent (TINUVIN 326, supplied by Ciba Geigy) | 2 parts |
| Solvent (toluene/methyl isobutyl ketone = 5/1) | 88 parts |

The heat adhesive resin and the ultraviolet absorbent were fully dissolved in the solvent. The resultant solution was applied to a commercially available, 80 μm thick white polyurethane resin film such that the dry coating thickness was 0.5 μm, and fully dried with hot air to form a heat-sensitive image-receiving layer on the polyurethane resin film. Thereafter, the so-obtained film and the same adhesive-applied releasable paper sheet as that described in Preparation Example 3 were laminated to give an adhesive-applied Marking film E.

PREPARATION EXAMPLE 6

Marking film F

The raw materials for forming the image-receiving layer of a marking film F and their amounts were as shown below.

| Image receiving layer | |
|---|---|
| Heat-bonding resin (VYLON 130, Tg 15° C., polyester resin, supplied by Toyobo Co., Ltd.) | 5 parts |
| Heat-bonding resin (MONOPET SB, melting point 78° C., sucrose octabenzoate, supplied by Daiichi Kogyo Seiyaku Co., Ltd.) | 5 parts |
| Solvent (toluene/methyl isobutyl ketone = 5/1) | 90 parts |

An adhesive-applied marking film F was obtained in the same manner as in Preparation Example 5 except that the white polyurethane resin film was replaced with a commercially available, 80 μm thick transparent vinyl chloride resin film and that the raw materials for an image receiving layer were changed as described above. The mixture of the above heat adhesive resins had Tg of 42° C.

PREPARATION EXAMPLE 7

Marking film G

The raw materials for forming an image receiving layer and their amounts were as shown below.

| Image receiving layer | |
|---|---|
| Heat-bonding resin (PLACCEL H7, melting point 60° C., polycaprolactone, supplied by Daicel Chemical Industries, Ltd.) | 10 parts |
| Solvent (toluene/methyl isobutyl ketone = 5/1) | 90 parts |

The heat adhesive resin was completely dissolved in the solvent. The resultant solution was applied to a commercially available, 100 μm thick white polyethylene terephthalate (PET) film with a bar coater such that the dry coating thickness was 1 μm, and fully dried with hot air to form a heat-sensitive image-receiving layer, whereby a marking film G was obtained.

PREPARATION EXAMPLE 8

Marking film H

The raw materials for an image receiving layer and their amounts were as shown below.

| Image receiving layer | |
|---|---|
| Heat-bonding resin (VYLON 130, Tg 15° C., polyester resin, supplied by Toyobo Co., Ltd.) | 12 parts |
| Fluorine-containing copolymer resin (FT-130, softening point 95° C., supplied by Asahi Glass Co., Ltd.) | 3 parts |
| Solvent (toluene/methyl ethyl ketone = 5/1) | 85 parts |

A marking film F was obtained in the same manner as in Preparation Example 7 except that the component for an image receiving layer was changed as described above. The mixture of the above heat adhesive resins had Tg of 18° C.

PREPARATION EXAMPLE 9

Marking film I

The raw materials for an image receiving layer and their amounts were as shown below.

| Image receiving layer | |
|---|---|
| Heat-bonding resin (VYLON 103, Tg 155° C., polyester resin, supplied by Toyobo Co., Ltd.) | 8 parts |
| Silicon-modified urethane resin (DAIAROMER SP2105, softening point 95° C., supplied by Dainichiseika Colour & Chemicals Mfg. Co., Ltd.) | 2 parts |
| Solvent (toluene/methyl ethyl ketone = 1/1) | 90 parts |

An adhesive-applied marking film I was obtained in the same manner as in Example 5 except that the raw materials for an image receiving layer were changed as described above. The mixture of the heat adhesive resins had a softening point of 150° C.

PREPARATION EXAMPLE 10

Marking film J

The raw materials for an image receiving layer and their amounts were as shown below.

| Image receiving layer (1) | |
|---|---|
| Heat-bonding resin (KEMIT R99, Tg −19° C., polyester resin, supplied by Toray Industries, Inc.) | 15 parts |
| Solvent (toluene/methyl ethyl ketone = 1/1) | 85 parts |
| **Image receiving layer (2)** | |
| Heat-bonding resin (VYLON 103, Tg 155° C., polyester resin, supplied by Toyobo Co., Ltd.) | 15 parts |
| Solvent (toluene/methyl ethyl ketone = 1/1) | 85 parts |

The heat adhesive resin for an image receiving layer (1) was completely dissolved in the solvent, and the resultant solution was applied to a commercially available, 100 μm thick white vinyl chloride resin film with a bar coater such that the dry coating thickness was 0.5 μm, and fully dried with hot air to form a heat-sensitive image receiving layer (1). Then, the heat adhesive resin for an image receiving layer (2) was completely dissolved in the solvent, and the resultant solution was applied to the above-formed image receiving layer (1) with a bar coater such that the dry coating thickness was 0.1 μm, and fully dried with hot air to form a heat-sensitive image receiving layer (2). Then, the so-obtained film and the same adhesive-applied paper sheet as that obtained in Preparation Example 1 were laminated in the same manner as in Preparation Example 1 to give a marking film J.

PREPARATION EXAMPLE 11

Marking film K

The raw materials for an image receiving layer (2) and their amounts were as shown below.

| Image receiving layer (2) | |
|---|---|
| Heat-bonding resin (VYLON 103, Tg 158° C., polyester resin, supplied by Toyobo Co., Ltd.) | 10 parts |
| Silicon-modified urethane resin (DAIAROMER SP2105, softening point 95° C., supplied by Dainichiseika Colour & Chemicals Mfg. Co., Ltd.) | 5 parts |
| Solvent (toluene/methyl ethyl ketone = 1/1) | 85 parts |

The same heat adhesive resin for an image receiving layer (1) as that used in Preparation Example 10 was completely dissolved in the same solvent as that used in Preparation Example 10, and the resultant solution was applied to a commercially available, 70 μm thick white polyurethane resin film with a bar coater such that the dry coating thickness was 0.5 μm, and fully dried with hot air to form a heat-sensitive image receiving layer (1). Then, the heat adhesive resin for an image receiving layer (2) was completely dissolved in the solvent, and the resultant solution was applied to the above-formed image receiving layer (1) with a bar coater such the dry coating thickness was 0.1 μm, and fully dried with hot air to form a heat-sensitive image receiving layer (2), whereby a marking film K was obtained. The mixture of the resins for the heat-sensitive image receiving layer (2) had a softening point of 150° C.

PREPARATION EXAMPLE 12

Marking film L

The same adhesive processing as that in Preparation Example 1 was worked on a commercially available, 100 μm thick white vinyl chloride resin film to brain a marking film L.

PREPARATION EXAMPLE 13

Thermal transfer ribbon 1

The raw materials for a separable layer and their amounts and the raw materials for a coloring ink layer and their amounts were as shown below.

| Separable layer | |
|---|---|
| Ethylene-vinyl acetate copolymer resin (EVAFLEX V577-2, supplied by Du Pont-Mitsui Polychemicals Co., Ltd.) | 5 parts |
| Carnauba wax (Carnauba wax No. 1, supplied by Noda Wax) | 20 parts |
| Toluene | 50 parts |
| Isopropyl alcohol | 25 parts |
| **Coloring ink layer** | |
| Polyester resin (VYLON 200, supplied by Toyobo Co., Ltd.) | 4 parts |
| Sucrose octabenzoate (MONOPET SB, supplied by Diichi Kogyo Seiyaku Co., Ltd.) | 6 parts |
| Carbon black | 10 parts |
| Dispersant | 0.5 part |
| Toluene | 40 parts |
| Methyl ethyl ketone | 40 parts |

The raw materials for a separable layer were fully dispersed and mixed with a ball mill to prepare a coating solution. The coating solution was applied to one surface of a 4.5 μm thick polyethylene terephthalate film by a gravure coating method such that the dry coating thickness was 1 μm. The other surface of the polyethylene terephthalate film had a heat-resistant back coating. The raw materials for a coloring ink layer were fully dispersed and mixed with a sand mill to prepare a coating solution. The coating solution was applied to the separable layer by a gravure coating method such that the dry coating thickness was 1 μm to form a coloring ink layer, whereby a thermal transfer ribbon 1 was obtained.

PREPARATION EXAMPLE 14

Thermal transfer ribbon 2

The raw materials for a coloring ink layer and their amounts were as shown below.

| Coloring ink layer | |
|---|---|
| Polyester resin (VYLON 103, supplied by Toyobo Co., Ltd.) | 10 parts |
| Carbon black | 10 parts |
| Dispersant | 0.5 part |

-continued

| Coloring ink layer | |
|---|---|
| Toluene | 40 parts |
| Methyl ethyl ketone | 40 parts |

A thermal transfer ribbon 2 was obtained in the same manner as in Preparation Example 13 except that the raw materials for a coloring ink layer were changed as described above.

PREPARATION EXAMPLE 15

Thermal transfer ribbon 3

The raw materials for a coloring ink layer and their amounts were as shown below.

| Coloring ink layer | |
|---|---|
| Acrylic resin (DAIANAL BR112, supplied by Mitsubishi Rayon Co., Ltd.) | 7 parts |
| Sucrose octabenzoate (MONOPET SB, supplied by Daichi Kogyo Seiyaku Co., Ltd.) | 3 parts |
| Carbon black | 10 parts |
| Dispersant | 0.5 part |
| Toluene | 40 parts |
| Methyl ethyl ketone | 40 parts |

A thermal transfer ribbon 3 was obtained in the manner as in Preparation Example 13 except that the raw materials for a coloring ink layer were changed as described above.

PREPARATION EXAMPLE 16

Thermal transfer ribbon 4

The raw materials for a coloring ink layer and their amounts were as shown below.

| Coloring ink layer | |
|---|---|
| α-Olefin/maleic anhydride/butyl methacrylate copolymer resin (molar ratio = 1/1/1, Mw = 50,000) | 10 parts |
| Carbon black | 8 parts |
| Dispersant | 0.5 part |
| Methyl isobutyl ketone | 40 parts |
| Methyl ethyl ketone | 40 parts |

A thermal transfer ribbon 4 was obtained in the same manner as in Preparation Example 13 except that the raw materials for a coloring ink layer were changed as described above.

PREPARATION EXAMPLE 17

Thermal transfer ribbon 5

The raw materials for a coloring ink layer and their amounts were as shown below.

| Coloring ink layer | |
|---|---|
| Polyester, resin (KEMIT SQ1380, supplied by Toray Industries, Inc.) | 14 parts |
| Carbon black | 6 parts |
| Dispersant | 0.1 part |
| Toluene | 40 parts |
| Methyl ethyl ketone | 40 parts |

A thermal transfer ribbon 5 was obtained in the same manner as in Preparation Example 13 except that the raw materials for a coloring ink layer were changed as described above.

PREPARATION EXAMPLE 18

Thermal transfer ribbon 6

The raw materials for an adhesive layer and their amounts were as shown below.

| Adhesive layer | |
|---|---|
| α-Olefin/maleic anhydride/butyl methacrylate copolymer resin (molar ratio 1/1/1, Mw = 50,000) | 10 parts |
| Toluene | 45 parts |
| Methyl ethyl ketone | 40 parts |

A coating solution for an adhesive layer, obtained from the above raw materials, was applied to the coloring ink layer of the same thermal transfer ribbon 1 as that obtained in Preparation Example 13 by a gravure coating method to form an adhesive layer having a dry coating thickness of 0.5 μm, whereby a thermal transfer ribbon 6 was obtained.

PREPARATION EXAMPLE 19

Thermal transfer ribbon 7

The raw materials for a coloring ink layer and their amounts were as shown below.

| Coloring ink layer | |
|---|---|
| Terpene resin (POLYSTAR T-100, supplied by Yasuhara Yushi Kogyo Co., Ltd.) | 5 parts |
| Carnauba wax | 12 parts |
| Carbon black | 3 parts |
| Dispersant | 0.1 part |
| Toluene | 80 parts |

A thermal transfer ribbon 7 was obtained in the same manner as in Preparation Example 13 except that the raw materials for a coloring ink layer were changed as described above.

PREPARATION EXAMPLE 20

Thermal transfer ribbon 8

The raw materials for a heat-melting ink layer and their amounts were as shown below.

| Heat-melting ink layer | |
|---|---|
| Ethylene-vinyl acetate copolymer resin (EVAFLEX V577-2, supplied by Du Pont-Mitsui Polychemicals Co., Ltd.) | 8 parts |
| Carbon black | 20 parts |
| Dispersant | 2 parts |
| Carnauba wax | 60 parts |
| Paraffin wax (melting point 155° F.) | 10 parts |

The above raw materials for a heat-melting ink layer were melted, fully dispersed and mixed under heat with a three-roll mill to give a heat-melting ink composition. This composition was applied to one surface of a 4.5 μm thick polyethylene terephthalate film whose other surface had been coated with a heat-resistant back coating by a hot melt coating method to form a heat-melting ink layer having a thickness of 4 μm, whereby a thermal transfer ribbon 8 was obtained.

Thermal Transfer Recording Method

The thermal transfer recording was carried out using various combinations of the marking films and thermal transfer ribbons by means of a thermal transfer copying machine (Paretic EC-10, supplied by Fuji Xerox Co., Ltd.).

Examples

The marking films and thermal transfer ribbons were combined as follows.

| Examples | Marking film | Thermal transfer ribbon |
|---|---|---|
| 1 | F | 1 |
| 2 | G | 3 |
| 3 | B | 1 |
| 4 | A | 4 |
| 5 | D | 1 |
| 6 | C | 7 |
| 7 | E | 8 |
| 8 | H | 5 |
| 9 | I | 1 |
| 10 | J | 2 |
| 11 | K | 3 |
| 12 | G | 6 |

Comparative Examples

The marking films and the thermal transfer ribbons were combined as follows.

| Comparative Examples | Marking film | Thermal transfer ribbon |
|---|---|---|
| 1 | L | 7 |
| 2 | L | 8 |
| 3 | L | 1 |

The marking films to which characters or patterns were thermal-transferred in Examples and Comparative Examples were evaluated fox outdoor weatherability, abrasion resistance, scratch resistance, adhesion and peelability of marking film as follows.

Outdoor weatherability

A marking film to which a character or pattern was thermal-transferred ("recorded marking film" hereinafter) was set at an outdoor exposure tester positioned toward the south at an angle of 45° from a horizontal line, and allowed to stand for 6 months.

Abrasion resistance

A recorded portion was evaluated by a coloring fastness to rubbing test (JIS L-0823).

Scratch resistance

A recorded portion was evaluated by a pencil hardness test (JIS K-5401).

Adhesion

A cellophane tape (18 mm width Cellotape, supplied by Nichiban Ltd.) was attached to a recorded portion and forcibly peeled. The peeling degree of a recorded portion was evaluated.

Peelability of marking film

A recorded marking film was attached to a smooth surface of a stainless steel sheet and bonded thereto with a 2 kg roller. Then, the stainless steel sheet with the recorded marking film attached thereto was allowed to stand in an environment having a temperature of 65° C. and RH of 80% for 168 hours, and then allowed to stand in an environment having a temperature of 23° C. and RH of 65% for 24 hours. The recorded marking film was peeled off from the stainless steel sheet, and the re-releasability was evaluated by observing whether or not there was a residual adhesive on the stainless steel sheet.

Table 1 shows the results.

TABLE 1

| | Resolution | Outdoor weather-ability | Abrasion resistance | Scratch resistance | Adhesion | Peel-ability- |
|---|---|---|---|---|---|---|
| Ex. 1 | A | A | A | A | A | A |
| Ex. 2 | A | A | A | A | A | A |
| Ex. 3 | A | A | AB | AB | AB | X |
| Ex. 4 | A | AB | AB | AB | A | X |
| Ex. 5 | A | AB | AB | AB | AB | — |
| Ex. 6 | A | A | B | B | B | A |
| Ex. 7 | A | AB | X | X | B | A |
| Ex. 8 | B | A | A | A | A | — |
| Ex. 9 | A | AB | A | A | A | A |
| Ex. 10 | A | A | A | A | A | X |
| Ex. 11 | A | AB | A | A | A | — |
| Ex. 12 | A | A | A | A | A | — |
| CEx. 1 | A | A | BX | BX | X | X |
| CEx. 2 | A | A | X | X | X | X |
| CEx. 3 | A | A | AB | AB | X | X |

Notes:
Ex. = Example, CEx. = Comparative Example
A = Excellent, B = Good, X = Poor

What is claimed is:

1. A thermal transfer recording method, comprising the steps of:

forming a marking film selected from the group consisting of a plastic film comprising a heat adhesive resin and a plastic film having a heat-sensitive image-receiving layer thereon, the heat-sensitive image-receiving layer comprising a heat adhesive resin;

forming a thermal transfer ribbon by forming a heat-melting ink layer on one surface of a substrate by laminating a separable layer containing a wax and a coloring ink layer on the substrate, the coloring ink layer consisting essentially of a resin and a coloring material and containing substantially no wax; and forming a pattern on the marking film with the thermal transfer ribbon;

wherein at least one of the heat adhesive resin of the marking film and the resin of the color ink layer comprises sucrose benzoate.

2. The method of claim 1, wherein said step of forming a marking film selected from the group consisting of a plastic film comprising a heat adhesive resin and a plastic film having a heat-sensitive image-receiving layer thereon, the heat-sensitive image-receiving layer comprising a heat adhesive resin, further comprises using a resin having a glass transition temperature of −30° to 80° C. as the heat adhesive resin.

3. The method of claim 1, wherein said step of forming a marking film selected from the group consisting of a plastic film comprising a heat adhesive resin and a plastic film having a heat-sensitive image-receiving layer thereon, the heat-sensitive image-receiving layer comprising a heat adhesive resin, further comprises using a resin having a softening point or melting point of 40° to 180° C. as the heat adhesive resin.

4. The method of claim 1, wherein said step of forming a marking film selected from the group consisting of a plastic film comprising a heat adhesive resin and a plastic film having a heat-sensitive image-receiving layer thereon, the heat-sensitive image-receiving layer comprising a heat adhesive resin, further comprises forming the plastic film of at least one resin selected from the group consisting of a polyvinyl chloride resin, a urethane resin and a polyester resin.

5. The method of claim 1, wherein said step of forming a marking film selected from the group consisting of a plastic film comprising a heat adhesive resin and a plastic film having a heat-sensitive image-receiving layer thereon, the heat-sensitive image-receiving layer comprising a heat adhesive resin, further comprises using a resin comprising polycaprolactone having the formula of $-(CH_2CH_2CH_2CH_2CH_2COO)_n-$ as the heat adhesive resin.

6. The method of claim 1, wherein said step of forming a marking film selected from the group consisting of a plastic film comprising a heat adhesive resin and a plastic film having a heat-sensitive image-receiving layer thereon, the heat-sensitive image-receiving layer comprising a heat adhesive resin, further comprises forming the marking film such that one surface of the marking film is provided with a releasable sheet through an adhesive layer between the marking film and the releasable sheet, the other surface of the marking film having the pattern formed thereon by the thermal transfer ribbon in said step of forming a pattern.

7. The method of claim 6, wherein said step of forming a marking film further comprises providing the adhesive layer such that the adhesive layer has an adhesion strength of 50 to 1,000 gr/25 mm width as measured by JIS-Z0237 adhesive tape-adhesive sheet test method.

8. The method of claim 1, wherein said step of forming said thermal transfer ribbon comprises consecutively laminating the separable layer, the coloring ink layer and an adhesive layer on the substrate.

9. The method of claim 8, wherein said step of forming the thermal transfer ribbon further comprises providing the adhesive layer such that it contains a resin obtained by copolymerizing at least one compound selected from the group consisting of α-olefin having at least 6 carbon atoms, maleic anhydride and (meth)acrylate.

* * * * *